United States Patent [19]

Fuchigami et al.

[11] 4,218,533

[45] Aug. 19, 1980

[54] PROCESS FOR PRODUCING PHOTOGRAPHIC MATERIAL

[75] Inventors: Shuzo Fuchigami; Toshio Miyashiro, both of Minami-ashigara, Japan

[73] Assignee: Fuji Photo Film Co., Ltd., Minami-ashigara, Japan

[21] Appl. No.: 803,187

[22] Filed: Jun. 3, 1977

[30] Foreign Application Priority Data

Jun. 4, 1976 [JP] Japan ..... 51-65453

[51] Int. Cl.[2] ..... G03C 1/76

[52] U.S. Cl. ..... 430/512; 430/539; 430/621; 430/631; 430/935; 430/950; 427/57

[58] Field of Search ..... 96/109, 107, 101, 120, 96/114.5, 76, 94 R, 67, 111; 427/57, 30

[56] References Cited

U.S. PATENT DOCUMENTS

| | | | |
|---|---|---|---|
| 3,198,170 | 8/1965 | Onishi | 427/57 |
| 3,485,634 | 12/1969 | Owen et al. | 96/120 |
| 3,551,157 | 12/1970 | Salminen | 96/100 |
| 3,694,253 | 9/1972 | Gerber et al. | 96/94 R |
| 3,892,573 | 7/1975 | Tatsuta et al. | 427/57 |
| 4,021,247 | 5/1977 | Hinata et al. | 96/109 |

OTHER PUBLICATIONS

Making and Coating Photographic Emulsions Zelikman et al., Focal Press, N.Y. 1964, pp. 17–30.

Zelikman & Levi, Photographic Emulsions pp. 228–235, Focal Press, N.Y. ©1964.

*Primary Examiner*—J. Travis Brown

*Attorney, Agent, or Firm*—Sughrue, Rothwell, Mion, Zinn and Macpeak

[57] ABSTRACT

In the production of a photographic material by applying a coating composition to a continuously moving support, cold-setting the coating and drying the coating, an additive in the coating composition (e.g., a hardening agent or an antistatic agent), either partly or completely, is atomized by ultrasonic vibration, and supplied to the coating formed on the continuously moving support. Alternatively, the atomized additive is first supplied to the surface of a continuously moving support, and before the coating is completely dried, the coating composition is applied thereto.

18 Claims, 4 Drawing Figures

PROCESS FOR PRODUCING PHOTOGRAPHIC MATERIAL

BACKGROUND OF THE INVENTION

1. Field of the Invention

This invention relates to a process for producing a photographic material, and more specifically, to a method for incorporating additives during the production of a photographic material.

2. Description of the Prior Art

Generally, a photographic material is produced by coating a support with a coating composition, such as a silver halide-gelatin emulsion and or a coating solution for a non-light sensitive interlayer, (to be referred to hereinafter generically as a "coating composition"), cooling the coating to set the coating, and drying the coating. The general practice is to incorporate various additives in the coating composition during its preparation. Some types of additives, however, tend to react with gelatin or other chemicals in the coating composition, and will adversely affect the properties of the coating composition or of the coatings, the photographic characteristics of the photographic material, and the physical properties of the coating layer, such as reticulation, adhesion, melting point, abrasion resistance, wet-ability, anti-static property etc. obtained. When such additives are used, the coating composition must be applied immediately after the preparation of the coating composition in order to avoid such adverse effects. This imposes a restriction on the use of fast-acting additives. Furthermore, according to this practice, an additive whose distribution should desirably be controlled in a particular area, for example a surface modifier such as anti-static agents, matting agents etc. which should desirably be distributed and concentrated near the surface of the coating, cannot be incorporated in such a manner as to achieve the desired distribution.

SUMMARY OF THE INVENTION

An object of this invention is to remove the defects of the conventional process for producing a photographic material.

Another object of this invention is to provide a process permitting incorporation of fast acting additives into a coating composition without being limited to a specific period of time from the preparation of the coating composition to the coating of the coating composition.

Further another object of this invention is to provide a method whereby additives can be incorporated in the coating layer in a desired localized or limited area.

This object of the invention is achieved by atomizing additives by utilizing ultrasonic vibration, and spraying the atomized additives onto a continuously moving support or onto a coating previously applied on the continuously moving support.

BRIEF DESCRIPTION OF THE ACCOMPANYING DRAWINGS

Embodiments of the present invention are described below in detail by reference to the accompanying drawings in which.

DETAILED DESCRIPTION OF THE INVENTION

Figure 1:
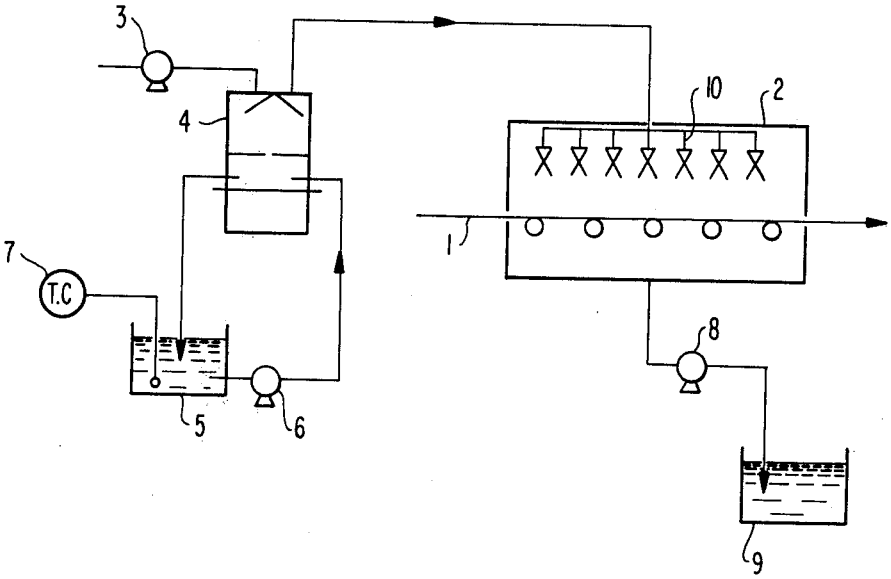
FIG. 1 is a schematic view of the principal parts of an apparatus for producing a photographic material in accordance with one embodiment of the invention.

In FIG. 1, reference numeral 1 represents a continuously moving support having a coating comprising a coating composition which is set by cooling but is still undried; 2, a spraying chamber; 3, an air blower; 4, an ultrasonic atomizer; 5, a reservoir for an additive; 6, a circulating pump; 7, a temperature control device; 8, an air exhaust; and 9, a recovery tank for the additive. Blow nozzles 10 are provided in the spraying chamber 2 in order to spray the additives atomized by the ultrasonic atomizer 4, onto the surface of the coating on the support 1.

The additive or additives to be atomized are circulated at a given flow rate between the ultrasonic atomizer 4 and the reservoir 5 while their temperature is controlled by the temperature control device 7 so as to prevent an increase in temperature that may occur due to ultrasonic vibration. A part of the additives is continuously atomized by the ultrasonic atomizer 4, and sent to the spraying chamber 2 by an air stream from the air blower 3. The atomized additives are then sprayed onto the coating through the blow nozzles 10. The support 1 having the undried coating on which the additives have thus been sprayed is passed to a drying zone and to a humidifying zone. Since the photographic material is dried immediately after the spraying of the additives, no undesirable reaction takes place between the additives and the emulsion and the constituents of the emulsion. Hence, a fast-acting additive or an additive which may adversely affect the properties of the coating composition or of the coating and the photographic characteristics of the photographic material with the passage of time can be used without any restriction.

Since in this embodiment, the additives are present in high concentrations near the surface of the coating, the effects of an additive, such as a surface modifier, which should desirably be locally distributed near the surface of the coating can be advantageously achieved.

After spraying, the atomized additives which are not used from the spraying chamber 2 together with air by means of the air exhaust 8, and sent to the recovery tank 9 filled with a suitable solvent where the additives are recovered. The air exhaust 8 must permit a larger amount of air flow than the air blower 3 so as to prevent air containing the additives from flowing out of the spraying chamber 2.

Figure 2:
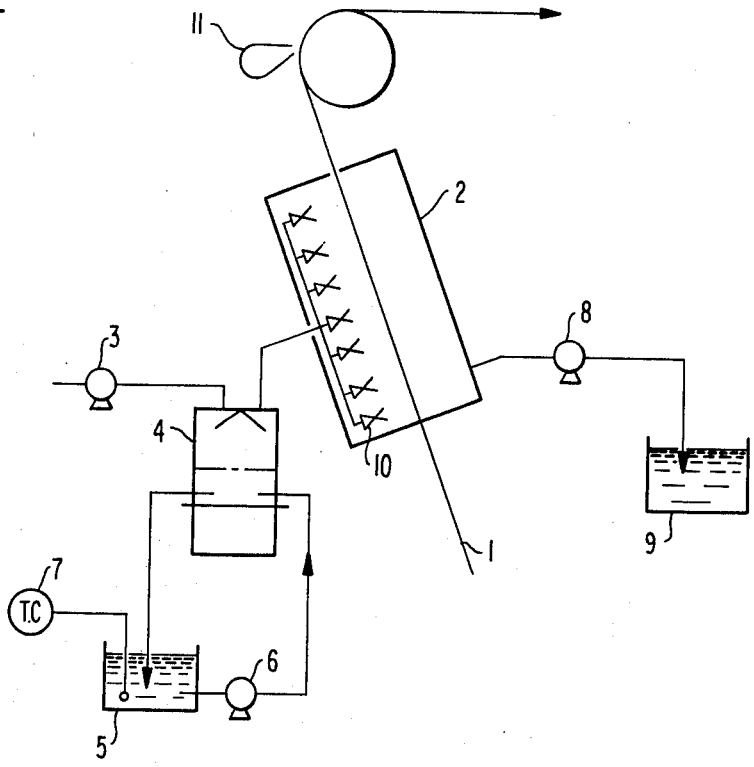
FIG. 2 is a schematic view of the principal parts of an apparatus for producing a photographic material in accordance with another embodiment of the invention.

Now, referring to FIG. 2, in another embodiment the atomized additives are sprayed onto the surface of support 1 before coating. Before the sprayed additives are completely dried, a coating composition is applied to the support by means of a coating device 11. More specifically when the amount of the additive coated is about 1 cc/m$^2$ or more, preferably 2 cc/m$^2$ or more, more preferably 5 cc/m$^2$ or more, the coating composition can be coated thereon. The coating composition is immediately set by chilling e.g., to about 0° to 10° C., and then sent to a drying and moisture adjustment zone. According to this embodiment, the additives can be distributed in high concentrations at that surface of the coating which is near the support.

It should be understood as a matter of course that the invention is not limited to the specific embodiments described above, and various modifications and changes are possible.

For example, in the embodiment shown in FIG. 1, the additives are sprayed on the undried coating after cold setting. This is done in order to prevent the coating from being roughened by the spray of the additives, and not because it is essential for the spraying to be performed after cold-setting the coating. Moreover, the method of spraying is not limited to the use of blow nozzles, but a method based on electrostatic coating principles can also be used e.g., as disclosed in J. L. Booth, *Coating Equipment and Processes,* pages 246–250 Lockwood Publishing Co., Inc. (1970). According to the electrostatic method, the efficiency of adhesion of the additives can be greatly increased, and the additives can be adhered with very good efficiency not only to an undried coating alone, but also to a dried coating.

A typical example of a fast-acting additive to which this invention is particularly effective is a hardening agent.

More particularly, suitable hardening agents to which this invention is applicable include inorganic and organic hardening agents, for example, chromium salts (e.g., chrome alum, chrome acetate acid, etc.), aldehyde group containing compounds (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), activated vinyl compounds (e.g., 1,3,5-triacyloylhexahydro-s-triazine, bis-(vinylsulfonyl)methyl ether, etc.), activated halogen compounds (e.g., 2,4-dichloro-6-hydroxy-s-triazine, etc.), mucohaloic acids (mucochloric acid, phenoxymucochloric acid etc.), isoxazole group containing compounds, dialdehyde starch, 2-chloro-6-hydroxytriazinylated gelatin, etc. These hardening agents can be used alone or as combinations thereof. Specific examples of such compounds are disclosed in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 3,543,292, British Pat. Nos. 676,628, 825,544, and 1,270,578, West German Pat. Nos. 872,153 and 1,090,427 and Japanese Patent Publication Nos. 7133/1959 and 1872/1971.

Typical examples of the additives whose distribution is desirably controlled in localized areas are antistatic agents, matting agents, surface-active agents, and ultraviolet light absorbents.

More specifically, suitable matting agents are those having an average particle size of about 2 to 5$\mu$ and examples include inorganic materials such as silica (silicon dioxide), magnesium oxide, titanium dioxide, calcium carbonate, and/or organic materials such as polymethylmethacrylate, cellulose acetate propionate etc.

Specific ultraviolet-light absorbents include benzotriazole compounds substituted with an aryl group (for example as disclosed in U.S. Pat. No. 3,533,794), 4-thiazolidone compounds (for example as disclosed in U.S. Pat. Nos. 3,314,794 and 3,352,681), benzophenone compounds (for example as disclosed in Japanese Patent Application No. (OPI) 2784/1971), cinnamic acid ester compounds (for example as disclosed in U.S. Pat. Nos. 3,705,805, and 3,707,375) and benzoxazole compounds (for example as disclosed in U.S. Pat. No. 3,499,762.) Further, the invention is applicable to ultraviolet light absorbing couplers (for example cyan dye forming couplers of the $\alpha$-naphthol type) and ultraviolet light absorbing polymers.

Specific examples of antistatic agents include delete hygroscopic materials, water soluble inorganic salts, certain types of surface active agents and polymers. For example, the polymers disclosed in U.S. Pat. Nos. 2,882,157, 2,972,535, 3,062,785, 3,262,807, 3,514,291 and 3,615,531; the surface active agents disclosed in British Pat. No. 861,134 and U.S. Pat. Nos. 2,982,651, 3,428,456, 3,457,076, 3,454,625, 3,552,972 and 3,655,387; and zinc oxide, semi-conductors, colloidal silica etc. disclosed in U.S. Pat. Nos. 3,062,700, 3,245,833 and 3,525,621 can be used.

Specific examples of nonionic surface active agents include saponin, alkylene oxide derivatives (for example; polyethyleneglycol, polyethyleneglycol/polypropyleneglycol condensates, polyethyleneglycol alkyl or alkaryl ethers, polyethyleneglycol esters, polyethyleneglycolsorbitan esters, polyalkyleneglycolalkylamines or amides, polyethyleneoxide-silicone adducts, etc.); glycidol derivatives (for example; alkenylsuccinate polyglycerides, alkylphenol polyglycerides etc.); fatty acid esters of polyhydric alcohols, alkylesters of sucrose, urethanes or ethers of sucrose; anionic surface active agents containing carboxy, sulfo, phospho or sulfate ester groups such as triterpenoidsaponin alkylcarboxylates, alkylsulfonates, alkylnaphthalene sulfonates, alkylsulfates, alkylphosphates, N-acyl-N-alkyltaurines, sulfosuccinates, sulfoalkylpolyoxyethylene alkylphenyl ethers, polyoxyethylnealkylphosphoric acid esters; amphoteric surface active agents such as aminoacids; aminoalkylsulfonic acids, aminoalkylsulfuric acid or phosphoric acid esters, alkylbetaines, amineimides, amine oxides; cationic surface active agents such as alkylamine, aliphatic or aromatic quaternary ammonium salts, heterocyclic quaternary ammonium salts such as pyridiniums imidazoliums, and phosphonium or sulfonium salts containing aliphatic or heterocyclic groups.

Examples of surface active agents are specifically disclosed in U.S. Pat. Nos. 2,240,472, 2,831,766, 3,158,484, 3,210,191, 3,294,540 and 3,507,660, British Pat. Nos. 1,012,495, 1,022,878, 1,179,290 and 1,198,450, Japanese Patent Application Nos. (OPI) 117414/1975 and 59025/1975, U.S. Pat. Nos. 2,739,891, 2,823,123, 3,068,101, 3,415,649, 3,666,478, 3,756,828, 3,133,816, 3,441,413, 3,475,174, 3,545,974, 3,726,683, 3,843,368, 2,271,623, 2,288,226, 2,944,900, 3,253,919, 3,671,247, 3,772,021, 3,589,906, 3,666,478 and 3,754,924, British Pat. Nos. 1,397,218, 1,138,514, 1,159,825 and 1,374,780, West German Patent Application No. (OLS) 1,961,638, Belgian Pat. No. 731,126 and Japanese Publication Nos. 378/1965, 379/1965, and 13822/1968.

Suitable supports which can be used in this invention include films comprising a semisynthetic or synthetic polymer such as nitrocellulose, cellulose acetate, cellulose acetate butyrate, polystyrene, polyvinyl chloride, polyethyleneterephthalate, polycarbonates, etc. and papers coated or laminated with a baryta layer or an olefin $\alpha$-polymer such as polyethylene, polypropylene, an ethylene/butene copolymer. The supports may be colored with dyes and/or pigments or rendered light intercepting. The surface of the supports are usually coated with a subbing layer to improve adhesion of the photographic emulsion layer.

Further, the surface of the supports may be treated using a corona discharge, ultraviolet radiation, a flame treatment, before or after the under coating process.

Droplets of additives as described above to be sprayed in accordance with this invention must be extremely fine and have a narrow particle diameter distribution. Suitably, they should have a particle diameter distribution of about 0.5 to about 15μ, preferably 0.5 to 10μ, more preferably 0.5 to 5μ. If the size of the droplets is larger than about 15μ, the drying load increases and the coating may be left undried. Furthermore, droplets larger than this occasionally cannot be completely carried by an air blower. On the other hand, droplets with a size of less than about 0.5μ are undesirable because they are difficult to adhere to the support or coated composition.

A suitable amount of the additive in the droplets will vary depending, for example, on the type of the additive, the type of the coating composition, or to what position of the support or the coating thereon the droplets are to be supplied. Generally, however, a suitable amount of the additive applied is about 0.1 to about 10 cc/m$^2$, preferably 0.2 to 7 cc/m$^2$, more preferably 0.5 to 5 cc/m$^2$.

The additives are generally sprayed as an aqueous solution, or as a solution of an organic solvent such as methanol. The ultraviolet light absorbents may be sprayed in the form of a mixed solvent solution comprising an oil such as dibutylphthalate and an organic solvent such as ethyl acetate.

A suitable solution concentration which can be used is one which can be sprayed. That is, all that is necessary is that the solution containing the additive be capable of being sprayed. From a practical standpoint a concentration up to a saturated solution can be employed. Specifically, for the hardening agent a suitable concentration ranges from about 0.1 to about 20 wt%; a suitable concentration for the matting agent is about 0.3 wt% or less; a suitable concentration for the surface active agent ranges from about 0.01 to about 10 wt%; a suitable concentration for the anti-static agent e.g., disclosed in U.S. Pat. Nos. 2,822,157 & 3,615,531 above is about 0.01 to 1 wt% e.g., disclosed in British Pat. No. 861,134 & U.S. Pat. No. 3,655,387 above is about 5 wt% or less and, e.g., zinc oxide, semiconductors, colloidal silica etc. is about 0.3 wt% or less and a suitable concentration for the ultraviolet-light absorbent is about 0.3 wt% or less. These ranges, however, are merely exemplary and are not to be construed as limitative.

In order to provide these fine droplets having a narrow particle size distribution, atomization must be performed by ultrasonic vibration. In the ultrasonic vibration method employed in this invention a suitable frequency of vibration is about 0.5 to 5 MHz, preferably 1.0 to 2.0 MHz, and a suitable temperature ranges from about 0° to 50° C., preferably 20° to 40° C. An appropriate time is dependent upon the spraying amount desired and a suitable air velocity which can be used ranges from about 1 to about 10 m/sec, preferably 3 to 6 m/sec with this measurement being at the surface of support. In contrast to atomization using ultrasonic vibration the well-known conventional air jet method or spray method provides droplets generally having a particle size distribution of about 0.5 to 50μ. The distribution is so broad that such a method cannot be used to produce droplets which are very fine and have a narrow particle size distribution as in the present invention.

Once the desired coated amount has been achieved suitable drying conditions which can be used are a temperature of about 20° to about 50° C. and a relative humidity of about 50 to 70%, with a stream of, e.g., air at a velocity of about 1 to about 30 m/sec at the surface of the support or the layer being coated.

The present invention results in the ability to achieve new advantages not previously achieved and some of which are described below.

(1) A fast-acting additive which has a tendency to react with gelatin or other chemicals in the coating composition with the passage of time, and as a result to adversely affect the properties of the coating composition, the photographic characteristics of the photographic material, and the properties of the coating layer, can be incorporated in the coating without such adverse effects occurring.

(2) An additive whose distribution in the coating should desirably be controlled in a certain area can be incorporated in the desired distribution.

The following examples are given to illustrate the invention in greater detail.

EXAMPLE 1

Varying amounts of 2,4-dichloro-6-hydroxy-1,3,5-triazine (2 wt% aqueous solution), as a hardening agent were added to a coating composition having the formulation shown in Table 1 below. Each of the resulting mixtures was coated on a polyethylene terephthalate film base having a width of 1400 mm and a thickness of 250μ and running at a rate of 50 m/min in an amount of 100 cc/m$^2$, and then dried, thereby to produce samples of Group A.

The coating composition shown in Table 1 was coated on the same base and cold-set. Varying amounts of the same hardening agent were atomized, and sprayed onto the cold-set coating under the conditions shown in Table 2, followed by drying to form samples of Group B.

Table 1

| | parts by weight |
|---|---|
| Aqueous Solution of Gelatin (10% by weight) | 1000 |
| Silver Bromide | 160 |
| p-Styrenesulfonic Acid-type Thickener (p-styrene sulfonate homopolymer; mol.wt.: about 100,000) | 5 |
| Anionic Sulfonic Acid-type Surfactant (dodecylbenzene sulfonate) | 2 |

Table 2

| | |
|---|---|
| Frequency of Ultrasonic Waves | 1.4 MHz |
| Particle Size of Atomized Particles | 2–4 μ (particle size distribution) |
| Velocity of Air Blown | 3 m/sec. |
| Spraying Temperature | 20° C. |

The relationship between the amounts of the hardener and the degree of hardness attained was measured with regard to the samples in Groups A and B. The results obtained are shown graphically in FIG. 3.

The degree of hardness is defined by the following relationship.

$$\text{Degree of Hardness} = \frac{\text{Thickness of Dry Coating } [\mu]}{A\ [\mu]} \times 100$$

wherein A is the thickness of the swollen coating finally attained when the sample is immersed for 3 minutes in water at 20° C.

When the amount of the hardener is zero, the coating dissolves during the 3-minute immersion. For the sake of convenience, the degree of hardness at this time is taken as zero.

Figure 3:
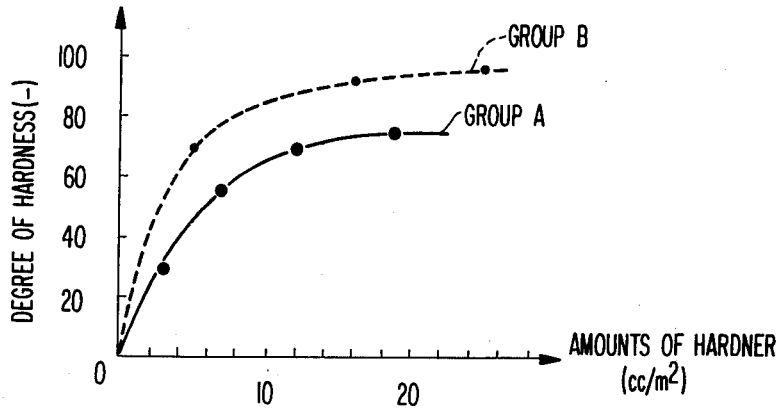
FIG. 3 is a graphic representation showing the results obtained in Example 1.

It can be seen from the results in FIG. 3 that according to the process of the present invention less than ½ of the amount of the hardener needs to be added in the atomized state, to obtain a coating having the same degree of hardness as the coating obtained by addition of the hardener to the coating composition in advance.

EXAMPLE 2

In quite the same manner as in Example 1, polyoxyethylene dodecyl ether (n-10) (1 wt% aqueous solution) was used as an antistatic agent and sprayed at a temperature of 20° C.

Figure 4:
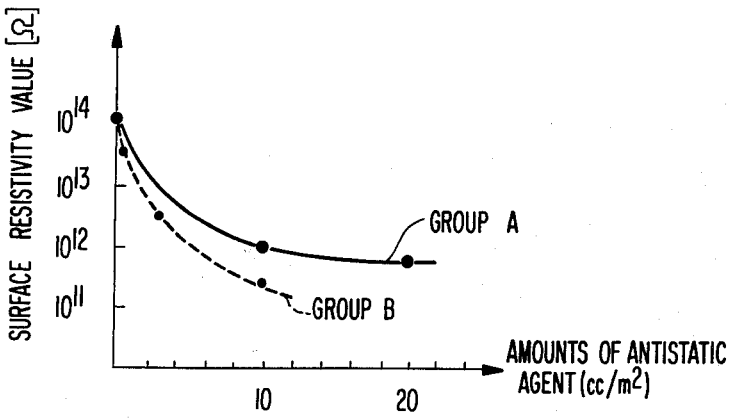
FIG. 4 is a graphic representation showing the results obtained in Example 2.

The relationship between the amounts of the antistatic agent and the surface resistivity values attained was determined, and the results obtained are shown in FIG. 4.

As can be seen from the results in FIG. 4, the process of the invention by which the antistatic agent is added in the atomized state provides the same surface resistivity as the process in which the antistatic agent is incorporated in advance using less than half of the amount of the antistatic agent in the latter process.

While the invention has been described in detail and with reference to specific embodiments thereof, it will be apparent to one skilled in the art that various changes and modifications can be made therein without departing from the spirit and scope thereof.

What is claimed:

1. A process for producing a photographic material which comprises applying a coating composition to a continuously travelling support, cold-setting the coating and then drying the coating; wherein the process includes atomizing a part or all of an additive to be incorporated in the coating composition by ultrasonic vibration, and supplying the atomized additive to the coating on the support, or supplying the atomized additive to the surface of the support and then coating the coating composition on the support before the additive thereon is completely dried.

2. The process of claim 1, wherein the atomized additive is in the form of droplets having a particle diameter distribution of about 0.5 to about 15μ.

3. The process of claim 1, wherein the amount of the atomized additive supplied is about 0.1 to about 10 cc/m$^2$.

4. The process of claim 2, wherein the amount of the atomized additive supplied is about 0.1 to about 10 cc/m$^2$.

5. The process of claim 1, wherein the additive is a hardening agent.

6. The process of claim 1, wherein the additive is an antistatic agent, a matting agent, a surface-active agent or an ultraviolet light absorbent.

7. A process for producing a photographic material which comprises applying a photographic emulsion to a continuously travelling support, cold-setting the photographic emulsion and then drying the photographic emulsion; wherein the process includes atomizing a part or all of an additive to be incorporated in the photographic emulsion by ultrasonic vibration, and supplying the atomized additive to the photographic emulsion on the support, or supplying the atomized additive to the surface of the support and then coating the photographic emulsion to the support before the additive thereon is completely dried.

8. The process of claim 7, wherein the photographic emulsion is a gelatin-silver halide emulsion.

9. The process of claim 8, wherein the atomized additive is in the form of droplets having a particle diameter distribution of about 0.5 to about 15μ.

10. The process of claim 8, wherein the amount of the atomized additive supplied is about 0.1 to about 10 cc/m$^2$.

11. The process of claim 7, wherein the amount of the atomized additive supplied is about 0.1 to 10 cc/m$^2$.

12. The process of claim 8, wherein the additive is a hardening agent.

13. The process of claim 8, wherein the additive is an antistatic agent, a matting agent, a surface-active agent or an ultraviolet light absorbent.

14. The process of claim 1, wherein the coating composition is a non light-sensitive coating containing gelatin.

15. The process of claim 14, wherein the atomized additive is in the form of droplets having a particle diameter distribution of about 0.5 to about 15μ.

16. The process of claim 14, wherein the amount of the atomized additive supplied is about 0.1 to about 10 cc/m$^2$.

17. The process of claim 14, wherein the additive is a hardening agent.

18. The process of claim 14, wherein the additive is an antistatic agent, a matting agent, a surface-active agent or an ultraviolet light absorbent.

* * * * *